US009671184B1

(12) United States Patent
Russo

(10) Patent No.: US 9,671,184 B1
(45) Date of Patent: Jun. 6, 2017

(54) GAS FLOW CONTROL MEMBER FOR FIREARM IMPINGEMENT BLOCK

(71) Applicant: Carmelo Russo, Port Richey, FL (US)

(72) Inventor: Carmelo Russo, Port Richey, FL (US)

( * ) Notice: Subject to any disclaimer, the term of this patent is extended or adjusted under 35 U.S.C. 154(b) by 0 days.

(21) Appl. No.: 15/156,253

(22) Filed: May 16, 2016

(51) Int. Cl.
*F41A 5/28* (2006.01)
*F41A 5/18* (2006.01)
*F41A 21/28* (2006.01)

(52) U.S. Cl.
CPC *F41A 5/18* (2013.01); *F41A 5/28* (2013.01); *F41A 21/28* (2013.01)

(58) Field of Classification Search
CPC ..... F41A 5/18
USPC ..... 89/193
See application file for complete search history.

(56) References Cited

U.S. PATENT DOCUMENTS 8,161,864 B1 * 4/2012 Vuksanovich ..... F41A 5/26 89/191.01
8,813,632 B2 * 8/2014 Adams ..... F41A 5/28 89/191.01

* cited by examiner

*Primary Examiner* — Reginald Tillman, Jr.
(74) *Attorney, Agent, or Firm* — Gulf Coast Intellectual Property Group

(57) ABSTRACT

A firearm impingement apparatus that includes a gas flow control member that is operable to provide incremental adjustment of gas flow within the gas block of the firearm impingement apparatus wherein the gas flow control member is configured to provide calibrated rotational movement thereof. The gas flow control member further includes a first portion, second portion and third portion contiguously formed. The first portion includes a plurality of longitudinal indentations circumferentially disposed thereon. The second portion has a diameter that is less than that of said first portion and said second portion. A mounting member is present adjacent an opening of a channel and includes a control pin biasly mounted therein that is operable to engage the gas flow control member. The control pin engages the longitudinal indentations to provide calibrated rotational movement of the gas flow control member.

2 Claims, 3 Drawing Sheets

GAS FLOW CONTROL MEMBER FOR FIREARM IMPINGEMENT BLOCK

CROSS REFERENCE TO RELATED APPLICATION

This application is a continuation-in-part application of U.S. patent application, Ser. No. 14/741,395 titled: FIREARM IMPINGEMENT BLOCK WITH ADJUSTABLE GAS FLOW CONTROL MEMBER, filed on Jun. 6, 2015 is herein incorporated for reference.

FIELD OF THE INVENTION

The present invention relates generally to firearms, more specifically but not by way of limitation, rifle impingement systems, both direct gas and gas piston systems wherein the impingement block of the present invention includes an adjustable gas flow control member operable to control the flow of gas directed into and outwards from the impingement block wherein the gas flow control member is structured so as to provide controlled incremental rotation thereof and is captively secured into the impingement block.

BACKGROUND

Rifles such as but not limited to the AR15 utilize impingement systems to cycle the bolt carrier during the firing process. As is known in the art, there are two types of impingement systems. A direct gas impingement system that is operably coupled to the barrel of the rifle and includes a port that is fluidly coupled to the barrel chamber allowing expanding gas to enter the impingement block. A portion of the gas created during the firing of a round escapes into the port and is routed back to the bolt carrier via the impingement system, which facilitates the cycling thereof so as to facilitate the loading of another round of ammunition into the firing chamber. Another style of impingement system is a gas piston impingement system. The gas piston impingement system also includes a port that is fluidly coupled to the barrel but leads to a piston chamber. The piston chamber contains a piston head wherein the piston head includes a piston rod extending therefrom having an end adjacent to the bolt carrier. During the firing process a portion of the gas is directed from the barrel and into the piston chamber which drives the piston rod rearward towards the bolt carrier in order to facilitate the movement thereof so as to cycle the bolt carrier in order to load another round of ammunition.

One problem with the current impingement systems is the continuous introduction of carbon-laden gas into either the gas tube and firing chamber or the piston chamber. As rounds are fired the accumulation of carbon and other contaminants build up in various areas of the firearm and reduce the effectiveness of its components. Without regular cleaning this can lead to the misfiring or jamming of the rifle during the shooting process.

Another problem with existing impingement systems is there lack of gas control. Both existing types of impingement systems utilize a method of controlling the gas flow from the barrel into the port that controls the input flow of gas into the gas block port of the impingement block. Utilization of this technique results in excess pressure on the impingement system block and excessive heat build-up. This technique further causes flow blow-back into the barrel and thus creating a need for more frequent cleaning of the barrel. This increases the wear on the component and ultimately leads to the early failure thereof.

Accordingly, there is a need for an impingement system for a firearm that is operable to control the gas flow into the impingement block so as to eliminate contaminant build-up in other areas of the firearm and reduce the heating of the impingement block so as to improve the overall performance of the firearm. Additionally, it is desired to have an impingement gas block that utilizes an adjustable gas flow control member that provides incremental adjustment thereof so the user can more precisely control the diversion of the gas flow in order to obtain desired performance.

SUMMARY OF THE INVENTION

It is the object of the present invention to provide an impingement gas block for a firearm that includes a gas block having an adjustable gas flow control member wherein the gas flow control member is configured to have calibrated rotational movement.

Another object of the present invention is to provide an impingement gas block for a firearm wherein the adjustable gas flow control member includes a shaft having a first portion, a second portion and a pin engagement portion intermediate thereto.

A further object of the present invention is to provide an impingement gas block for a firearm wherein the first portion of the shaft of the adjustable gas flow control member has at least three longitudinal indentations formed therein and wherein the longitudinal indentations are circumferentially disposed around the surfaces of first portion of the shaft.

An additional object of the present invention is to provide an impingement gas block for a firearm wherein impingement block further includes a mounting member adjacent the opening of the channel configured to receive the gas flow control member.

Yet a further object of the present invention is to provide an impingement gas block for a firearm that further includes control pin wherein the control pin is configured to bias against the shaft of the adjustable gas flow control member so as to provide calibrated rotational movement thereof and further limit rearward movement of the gas flow control member.

A further object of the present invention is to provide an impingement gas block for a firearm wherein the control pin is biasly mounted within the mounting member with a spring or similar element.

Another object of the present invention is to provide an impingement gas block for a firearm wherein control pin is secured within the mounting member utilizing a pin.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
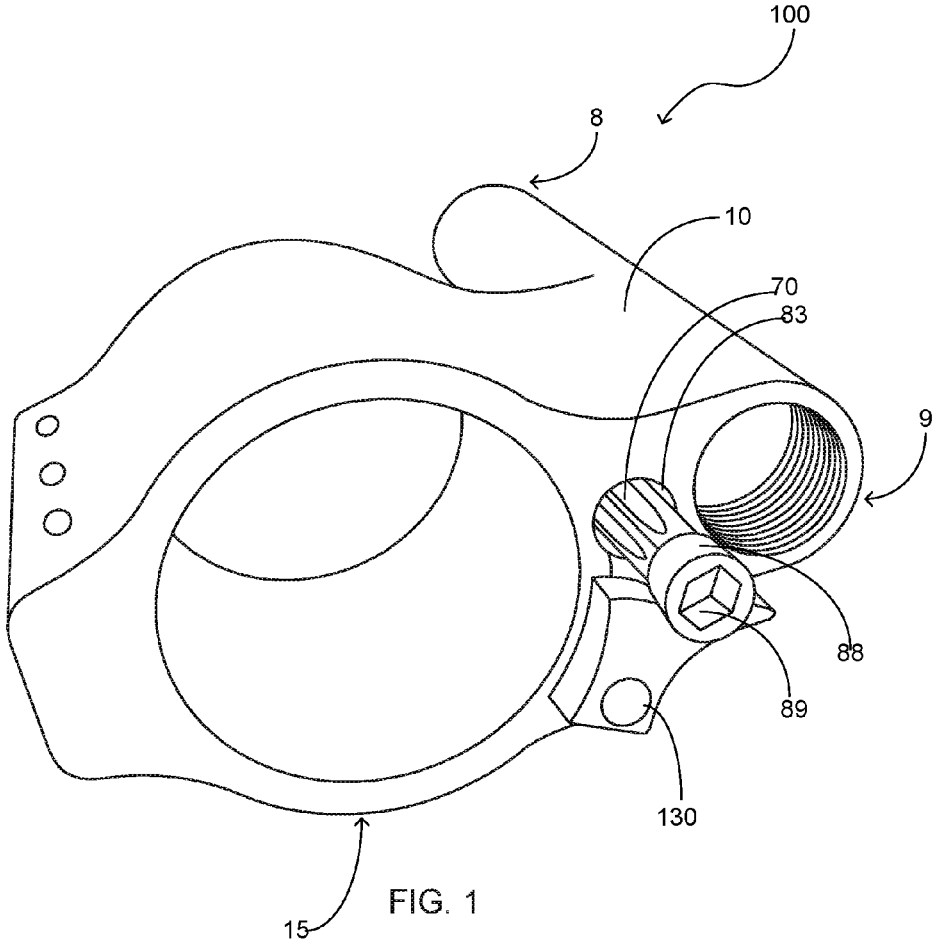
FIG. 1 is a perspective external view of an impingement block showing the mounting member and gas flow control member of the present invention.

Referring now to the drawings submitted herewith, wherein various elements depicted therein are not necessarily drawn to scale and wherein through the views and figures like elements are referenced with identical reference numerals, there is illustrated a gas flow control member and impingement block 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the gas flow control member and impingement block 100 is illustrated therein. The gas flow control member and impingement block 100 includes gas block 10 that includes barrel-mating sleeve 15. Gas block 10 includes first end 9 and second end 8. The gas block 10 and barrel-mating sleeve 15 are integrally formed utilizing suitable techniques and are manufactured from a suitable durable material such as but not limited to metal. The barrel-mating sleeve 15 is manufactured similarly to conventional barrel sleeves of existing impingement blocks wherein the barrel-mating sleeve 15 is configured to surroundably mount a barrel of a firearm and fluidly couple therewith as further discussed herein. The barrel-mating sleeve 15 is surroundably mounted to a barrel assembly of a firearm (not particularly illustrated herein) wherein the gas block port 50 bored within the gas block 10 is aligned and fluidly coupled with a conventional gas vent port of a barrel of a firearm.

As is known in the art, upon a round of ammunition being fired associated gas expands into the barrel of the firearm and a portion thereof travels into the gas block 10 via the gas block port 50. Gas entering the gas block 10 facilitates the operation of the gas flow control member and impingement block 100. The present invention is directed towards calibrated control of the gas flow entering the gas block 10 via gas block port 50. The gas block 10 includes a channel 80 that is hollow and fluidly coupled with gas block port 50. Channel 80 includes a first end 81 and second end 82 wherein an opening 83 is present at second end 82. The channel 80 extends from the gas block port 50 to the first end 9 of the gas block 10. The adjustable gas flow control member 90 is captively secured in channel 80. Adjustable gas flow control member 90 is manufactured from a suitable durable material such as but not limited to metal and includes a first portion 91, second portion 92 and third portion 93 with the first portion 91, second portion 92 and third portion 93 being contiguously formed. Formed with first portion 91 is head 88 having receptacle 89 configured to be mateably engaged with a conventional tool such as but not limited to an allen wrench. The first portion 91 of the adjustable gas flow control member 90 includes a plurality of longitudinal indentations 70 formed thereon that extend substantially the length of the first portion 91. The longitudinal indentations 70 are circumferentially adjacent on the first portion 91 and are parallel with each other. The longitudinal indentations 70 function to engage the control pin 110 to provide a calibrated rotational movement of the adjustable gas flow control member 90. The calibrated rotational movement of the adjustable gas flow control member 90 allows precise control movements when the adjustable gas flow control member 90 is at least partially superposed the gas block port 50 so as to provide control of the amount of gas flowing therethrough. It is contemplated within the scope of the present invention that the first portion 91 could have various quantities of longitudinal indentations 70 formed thereon but good results have been achieved utilizing at least three longitudinal indentations 70.

Figure 2:
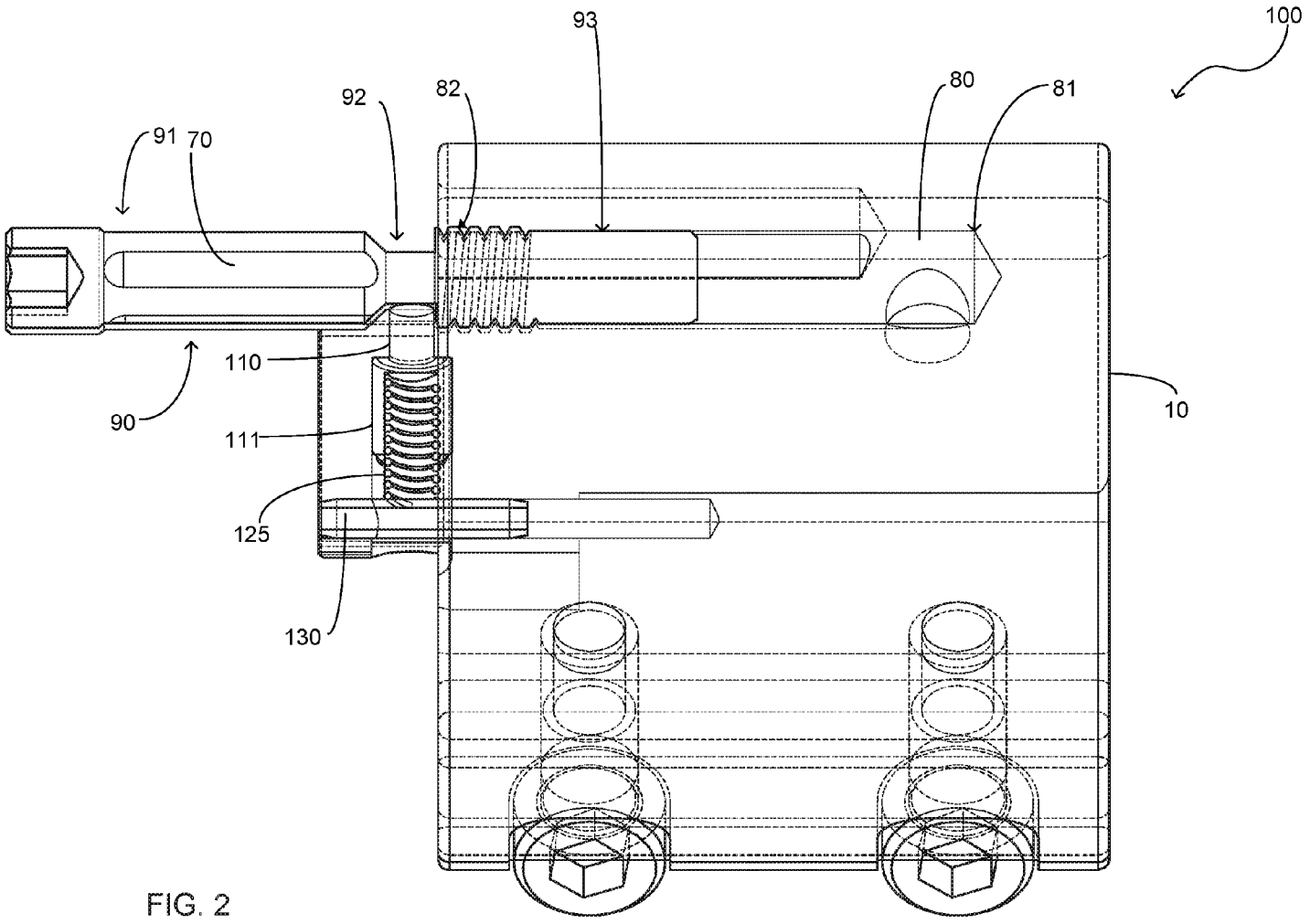
FIG. 2 is a cross-sectional view of an impingement block showing the gas flow control member in a first position.
Figure 3:
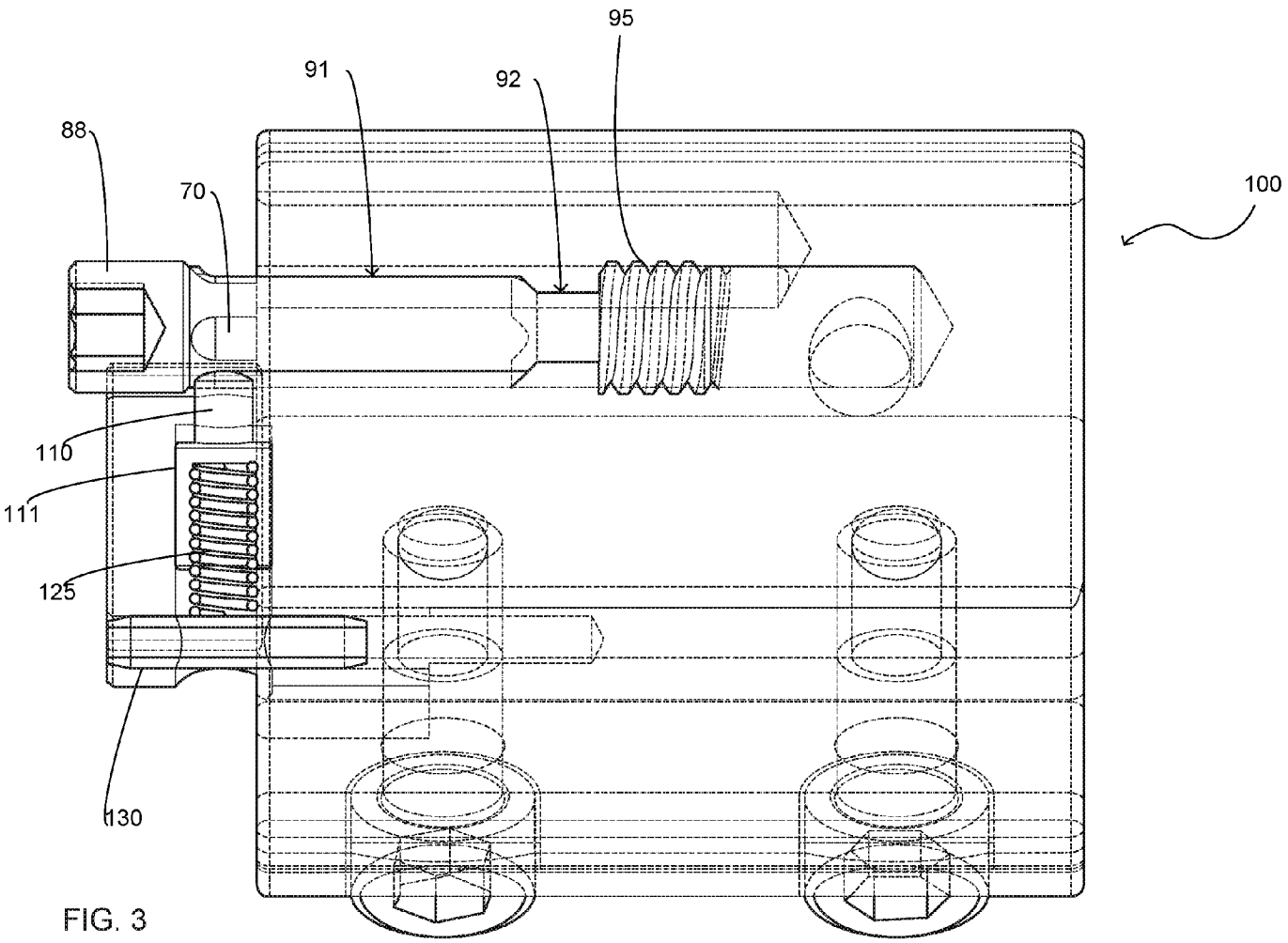
FIG. 3 is a cross-sectional view of an impingement block showing the gas flow control member in a second position.

Contiguously formed with the first portion 91 is second portion 92. The second portion 92 is manufactured having a diameter that is less than that of the diameter of the first portion 91 and third portion 93. The second portion 92 having the smaller diameter functions to inhibit the adjustable gas flow control member 90 from being completely removed from the channel 80. As shown in FIG. 2 herein, ensuing the adjustable gas flow control member 90 being rotated such that the control pin 110 has engaged the second portion 92, the control pin 110 is adjacent the third portion 93 which has perpendicular orientation with the second portion 92 and as such inhibits the further movement in an outward direction from the channel 80. The third portion 93 is contiguous with the second portion 92 and includes threads 95 circumferentially disposed thereon. Threads 95 function to control the rotation of the adjustable gas flow control member 90 within channel 80.

The gas flow control member and impingement block 100 includes mounting member 120. The mounting member 120 is secured to the gas block 10 utilizing suitable durable techniques such as but not limited to welding. Disposed within the mounting member 120 is control pin 110. As previously discussed herein, control pin 110 is operable to engage the longitudinal indentations 70 of the first portion 91 of the adjustable gas flow control member 90 so as to provide calibrated rotational movement thereof in order to precisely control the gas flow through gas port 50. It should be noted that the first portion 91 includes a substantial section that is external to the gas block 10. A significant advantage of this design is to inhibit the buildup of carbon and other deposits that typically accumulate during use of a firearm. As the first portion 91 and control pin 110 are substantially outside of the gas block 10 this ensures reduced contamination and improved performance. The control pin 110 is biasly mounted within the mounting member 120 with spring 125. Spring 125 is internally mounted within the body 111 of control pin 110 and is configured to maintain the control pin 110 in a biased position against the adjustable gas flow control member 90. It is contemplated within the scope of the present invention that the control pin 110 could be biasly mounted utilizing alternative elements than spring 125. The control pin 110 is secured in place within the mounting member 120 utilizing rod 130. Rod 130 is secured within the mounting member 120 utilizing suitable durable techniques and functions to maintain the control pin 110 within the mounting member 120.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm impingement apparatus comprising:

a gas block, said gas block being configured to surroundably mount to a barrel of a firearm, said gas block having a first end and a second end, said gas block further having a gas block port, said gas block port configured to be fluidly coupled with the barrel of the firearm, said gas block further having a channel, said channel having a first end and a second end, said channel having an opening proximate said second end of the channel, said channel being fluidly coupled with said gas block port proximate said first end of the channel;

a gas flow control member, said gas flow control member being secured within said channel, said gas flow control member having a first portion, a second portion and a third portion, said first portion, second portion and third portion being contiguous and longitudinally adjacent, said second portion of said gas flow control member is intermediate said first portion and said third portion, said second portion of said gas flow control member having a diameter that is less than that of said first portion and said third portion, said first portion of said gas flow control member having a plurality of longitudinal indentations, said plurality of longitudinal indentations being circumferentially disposed around said first portion, said gas flow control member being movable intermediate a first position and a second position, said gas flow control member operable to control the amount of gas exiting said gas block port;

a mounting member, said mounting member being secured externally to said gas block proximate the first end thereof, said mounting member being proximate said opening of said channel, said mounting member further including a control pin, said control pin having a body including a spring that is configured to bias said control pin against the gas flow control member, and wherein said plurality of longitudinal indentations of said first portion of said gas flow control member are configured to provide calibrated rotational movement of the gas flow control member as said control pin is biased thereagainst and wherein the second portion being contiguous with said third portion includes a perpendicular edge at a transition point to said third portion so as to engage said control pin inhibiting the removal of said gas flow control member from said channel during rotation of said gas flow control member.

2. The firearm impingement apparatus as recited in claim 1, and further including a rod, said rod configured to secure said control pin within said mounting member.

* * * * *